US008579150B2

(12) United States Patent
Janny

(10) Patent No.: US 8,579,150 B2
(45) Date of Patent: Nov. 12, 2013

(54) CONTAINER FOR STORING PRODUCTS

(75) Inventor: Pierre Janny, Peronne (FR)

(73) Assignee: Janny Sarl, Peronne (FR)

( * ) Notice: Subject to any disclaimer, the term of this patent is extended or adjusted under 35 U.S.C. 154(b) by 462 days.

(21) Appl. No.: 12/306,985

(22) PCT Filed: Jun. 29, 2007

(86) PCT No.: PCT/FR2007/001109

§ 371 (c)(1),
(2), (4) Date: Dec. 30, 2008

(87) PCT Pub. No.: WO2008/000971

PCT Pub. Date: Jan. 3, 2008

(65) Prior Publication Data

US 2009/0302036 A1 Dec. 10, 2009

(30) Foreign Application Priority Data

Jun. 30, 2006 (FR) ..... 06 05910

(51) Int. Cl.
*B65D 53/00* (2006.01)

(52) U.S. Cl.
USPC ..... 220/784; 220/310.1; 220/378; 220/795

(58) Field of Classification Search
USPC ..... 220/784, 310.1, 795, 614, 681, 785, 220/790, 780, 378, 786–789
See application file for complete search history.

(56) References Cited

U.S. PATENT DOCUMENTS

| | | | | |
|---|---|---|---|---|
| 4,043,482 | A * | 8/1977 | Brown | 220/783 |
| 4,538,380 | A | 9/1985 | Colliander | |
| 4,632,272 | A * | 12/1986 | Berenfield et al. | 220/324 |
| 4,821,911 | A * | 4/1989 | Lefrant | 220/614 |
| 5,911,334 | A * | 6/1999 | Helms | 220/359.4 |
| 6,364,152 | B1 | 4/2002 | Poslinski | |
| 2001/0010311 | A1 * | 8/2001 | Ciccone | 220/276 |
| 2006/0081635 | A1 * | 4/2006 | Matsutori et al. | 220/378 |

FOREIGN PATENT DOCUMENTS

| | | |
|---|---|---|
| DE | 4234088 | 4/1994 |
| DE | 20313677 | 11/2003 |
| EP | 0211743 | 2/1987 |
| EP | 0835826 | 4/1998 |
| WO | 2005109958 | 11/2005 |

OTHER PUBLICATIONS

International Search Report dated Dec. 11, 2007, in PCT application.

* cited by examiner

*Primary Examiner* — J. Gregory Pickett
*Assistant Examiner* — Robert Poon
(74) *Attorney, Agent, or Firm* — Young & Thompson

(57) ABSTRACT

A container for storing products includes a tub and a cover which is equipped with a seal positioned in a peripheral groove formed in the inner face of the cover. The tub includes an inner and outer flat peripheral rim, the cover including a vertical peripheral rim designed to cover the outer peripheral rim upon closure of the cover, and in that the inner and outer peripheral rims are in different planes and constitute a shouldered shape, the cover including, between its vertical peripheral rim and its inner face, a clearance with a shape matching the shouldered shape of the tub, the distance between the plane of the clearance and the plane of the inner face of the cover being less than the distance separating the planes of the peripheral rims of the tub.

19 Claims, 2 Drawing Sheets

CONTAINER FOR STORING PRODUCTS

The present invention concerns a container for the storage of products comprising a box in which the products are stored and a lid for closing said box in an airtight manner by means of a seal.

BACKGROUND OF THE INVENTION

Such airtight containers are used in particular for storing products, such as fruits and vegetables, or flowers, in a modified atmosphere, in order to increase the length of preservation of these products. The airtightness of the container is essential in order to maintain in the container the level of oxygen and carbon dioxide required for guaranteeing the best possible during of preservation. To ensure this airtightness, the containers generally comprise a seal arranged round the entire periphery between the box and the lid. This peripheral seal can be bonded to the internal face of the lid. However, this solution does not make it possible to change the seal when necessary. The seal may also simply be placed between the box and the lid and can then easily be changed when it is worn. However, this design is not satisfactory since it does not guarantee the correct positioning of the seal, which may then lose its efficacy. Another solution is also known, presented in the U.S. Pat. No. 6,364,152, which consists of providing a peripheral groove in the bottom face of the lid in order to house therein and hold therein one end of the seal, the other end of which comes to be crushed against the box and ensures the airtightness of the container when the lid closes the box.

The aim of the present invention is therefore to overcome these various drawbacks by proposing an alternative solution of a container comprising a seal that can be changed easily while guaranteeing maximum efficacy in the control of the airtightness and wear on the said seal.

SUMMARY OF THE INVENTION

For this purpose, and in accordance with the present invention, a container is proposed for the storage of products comprising two elements, namely a box in which the products are stored and a lid for closing the said box in an airtight manner by means of a seal, comprising a flat peripheral rim broken down into an internal flat peripheral rim and an external flat peripheral rim, the lid comprising a vertical peripheral rim arranged so as to cover the external peripheral rim of the box when the lid is closed and comprising on its internal face a peripheral groove disposed so as to come opposite the said flat peripheral rim of the box when the lid closes the box, the said seal comprising a crushing zone arranged to be crushed on the internal peripheral rim of the box in order to ensure airtightness when the lid closes the box and a foot extending along the longitudinal axis of the crushing zone on a plane perpendicular to the transverse axis of said crushing zone, said foot being intended to be positioned in the peripheral groove of the lid, characterised in that the internal and external peripheral rims are in different planes and constitute a shouldered shape and in that the lid comprises, between its vertical peripheral rim and its internal face, a step having a shape complementary to said shouldered shape of the box, the distance between the plane of the step and the plane of the internal face of the lid being less than the distance separating the planes of the internal and external peripheral rims of the box.

The seal, having firstly a part inserted in the peripheral groove on the internal face of the lid and secondly a crushing zone, can thus easily be extracted from the lid in order to be changed, while guaranteeing maximum airtightness.

In addition, it will be understood clearly that wear or excessive deformation of the seal is prevented when containers according to the invention are stacked on one another: this is because the height between the internal flat peripheral rim of the box and the internal face of the lid is fixed; when the lid closes the box, the step between the vertical peripheral rim and the internal face of the lid comes into abutment on the external peripheral rim of the box, the plane of the internal face of the lid then lying between the planes of the external and internal peripheral rims of the box.

BRIEF DESCRIPTION OF THE DRAWINGS

Other advantages and characteristics will emerge more clearly from the following description of a variant embodiment of a container according to the invention, given by way of non-limitative example, with reference to the accompanying drawings, in which.

DETAILED DESCRIPTION OF THE PREFERRED EMBODIMENTS

Figure 1:
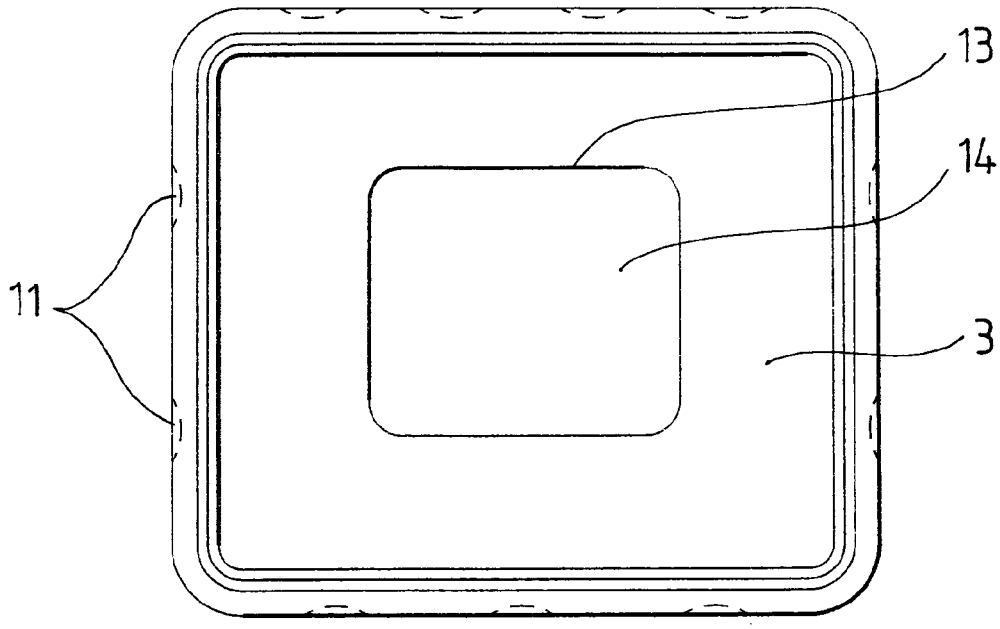
FIG. 1 is a plan view of a container according to the invention.
Figure 2:
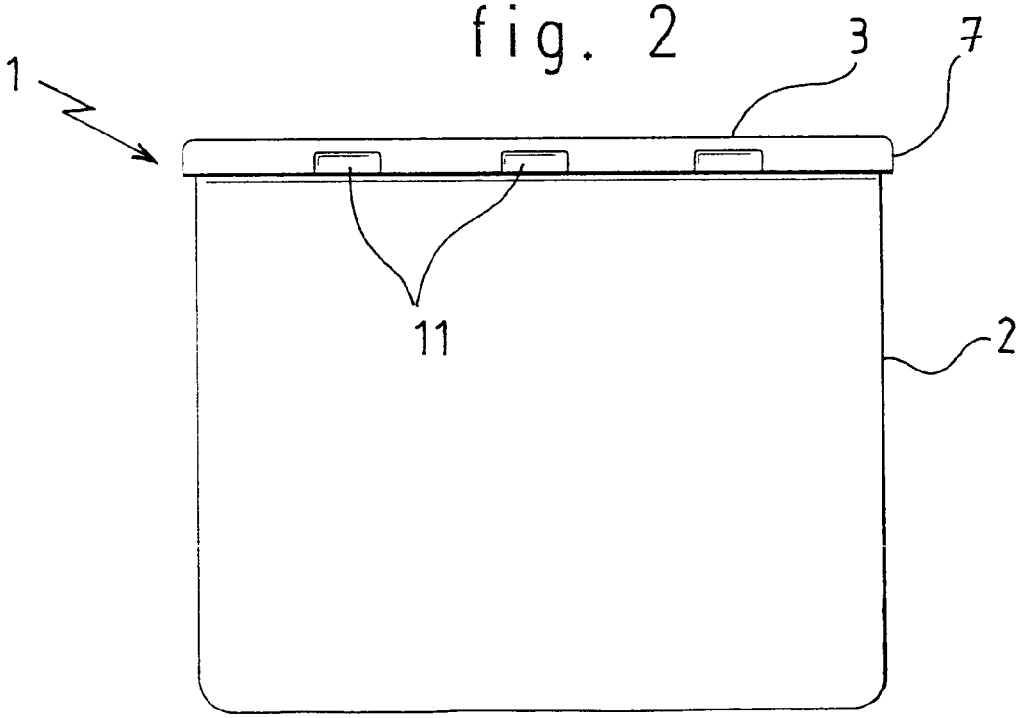
FIG. 2 is a side view of a container according to the invention.

With reference to FIGS. 1 to 4, a container 1 for storing products, such as fruits and vegetables or flowers, is shown. The container 1 comprises two elements, namely a box 2 in which the products are stored and a lid 3 for closing the box 2 in an airtight manner by means of a compressible seal 20.

The box 2 comprises a flat peripheral rim 4. In a preferred manner, the flat peripheral rim 4 of the box 2 is broken down into an internal flat peripheral rim 5 and an external flat peripheral rim 6, the said rims 5 and 6 being situated in different planes. According to a particularly preferred variant, and with reference more specifically to FIG. 3, the internal 5 and external 6 flat peripheral rims are situated in different planes and constitute a shouldered shape on the periphery of the box 2.

Figure 4:
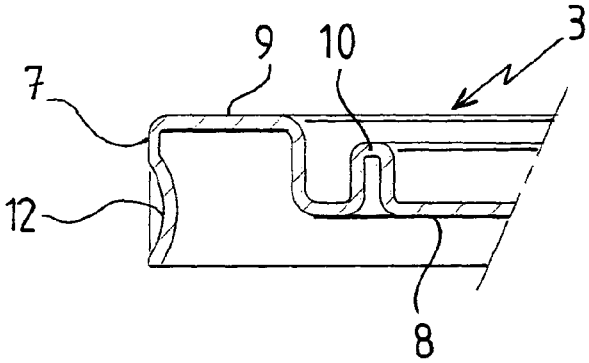
FIG. 4 is a view in partial section of the lid of the container according to the invention.

Preferably, the lid 3 comprises a vertical peripheral rim 7 arranged and sized so as to cover the external peripheral rim 6 of the box 2 and a flat internal face 8 with dimensions corresponding substantially to the opening of the box 2. As shown in FIG. 4, the lid 3 comprises, between its vertical peripheral rim 7 and its internal face 8, a substantially horizontal step 9 having a shape complementary to the shouldered shape of the periphery of the box 2.

Figure 6:
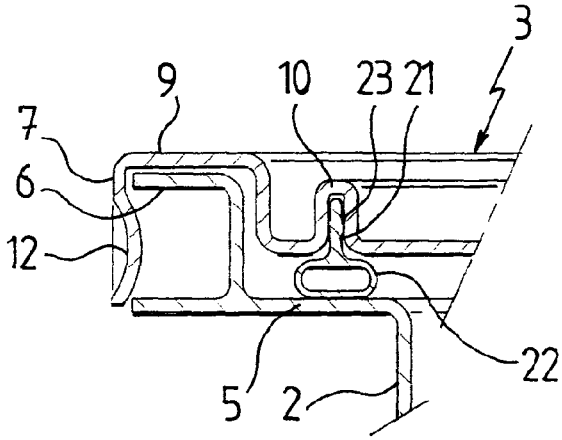
FIG. 6 is a view in partial section showing the lid closing the box of the container according to the invention.

In addition, the distance between the plane of the step 9 and the plane of the internal face 8 of the lid 3 is less than the distance separating the planes of the internal 5 and external 6 peripheral rims of the box 2. Thus, as shown in FIG. 6, when the lid 3 closes the box 2, the step 9 is abutted on the external peripheral rim 6 and the seal 20 is compressed according to a predefined factor in the space separating the plane of the internal face 8 of the lid 3 from that of the internal peripheral rim 5 of the box 2. The advantage procured by this conformation, which allows controlled compression of the seal 20 and prevents premature wear thereon because of an additional compression when the containers according to the invention are stacked on one another, will easily be understood.

According to the present invention, the lid 3 comprises, on its internal face 8, a peripheral groove 10 disposed so as to come opposite the internal flat peripheral rim 5 when the lid 3 closes the box 2, as shown in FIG. 6, which shows a particularly preferred variant embodiment of the invention.

It is very clear that the configuration described here can be reversed and that the groove 10 can be provided on the box 2 and the peripheral rims 4, 5, 6 on the lid 3.

Figure 5:
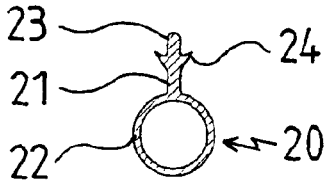
FIG. 5 is a view in section of a seal used in the container according to the invention.
Figure 3:
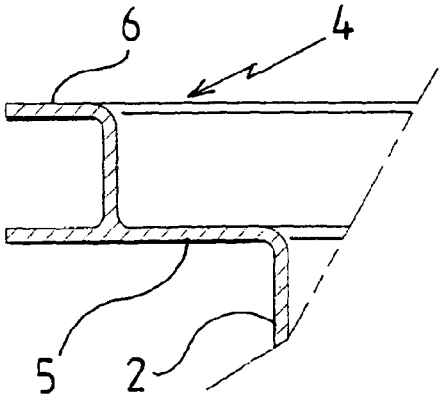
FIG. 3 is a view in partial section of the peripheral rim of the box of the container according to the invention.

With reference to FIGS. 5 and 6, the seal 20 comprises a crushing zone 22 arranged so as to be crushed on the internal flat peripheral rim 5 of the box 2, which is opposite the peripheral groove 10 of the lid 3 when the lid 3 closes the box 2 and a foot 21 extending along the longitudinal axis of the crushing zone 22 on a plane perpendicular to the transverse axis of the said crushing zone 22, the said foot 21 being intended to be forcibly positioned in the peripheral groove 10 of the lid 3. Thus the crushing zone 22 of the seal 20 is crushed on the internal flat peripheral rim 5 of the box 2 when the lid 3 closes the box 2, which guarantees the airtightness of the container 1. In addition, the foot 21 inserted and taken in the groove 10 on the internal face 8 of the lid makes it possible to fix the seal 20 to the said lid, eliminating any fixing by adhesive bonding. Preferably, the foot 21 comprises means 23 of attachment to the lid 3 arranged so as to make the seal 20 removable. Advantageously, the attachment means 23 comprise catches 24 having in cross section the shape of a fir tree, or any other protuberance affording good attachment of the foot 21 of the seal 20 on the lid 3.

Advantageously, the seal 20 is a hollow seal consisting of flexible material having good remanence.

In addition, the container 1 comprises means 11 of clipping the lid 3 to the box 2. Preferably, with reference to FIGS. 4 and 6, said clipping means 11 are formed by at least one hollowed-out protuberance 12 provided on the vertical peripheral rim 7 of the lid 3, said protuberance 11 being arranged so as to attach to the external flat peripheral rim 6 of the box 2 when the lid 3 closes the box 2. Preferably, the lid 3 is produced from a material that is sufficiently elastic to allow good snapping of the hollowed-out protuberance 12 onto the external peripheral rim 6 of the box 2. Thus, with reference to FIG. 6, when the lid 3 closes the box 2, the step 9 on the lid 3 comes opposite the complementary shouldered shape formed by the internal 5 and external 6 peripheral rims of the box 2, the protuberance 12 attaches to the external rim 6 of the box 2 in order to close the container 1, the seal 20 fixed to the lid 3 in the groove 10 comes opposite the internal peripheral rim 5 of the box 2 and the crushing zone 22 of the seal 20 is crushed on said internal peripheral rim 5 in order to create airtightness.

It is obvious that, instead of clipping the lid 3 onto the box 2, the cover can have a shape making it possible to attach it to the peripheral rim of the box. In addition, it will be clearly understood per se that a person skilled in the art will, without difficulty, be able to implement the invention by reversing the direction of the shoulder between the internal 5 and external 6 peripheral rims of the box, the distance between the plane of the step 9 and the plane of the internal face 8 of the lid then being greater than the distance separating the planes of the internal 5 and external 6 peripheral rims of the box 2, so as to form a space between the internal peripheral rim 5 and the internal face 8 of the lid 3 when the lid closes the box 2 and to have constant and predefined compression of the seal 20 between these two elements.

When the container 1 is used for the storage of products in a modified atmosphere, the lid 3 comprises at least one orifice 13 closed off by a semi-permeable membrane 14 arranged to allow the control of the passage of the gases from the ambient air selectively.

The present invention applies more particularly to the storage of fresh products requiring a guarantee of the airtightness of the container, but is it obvious that the example that has just been given is only a particular illustration in no way limitative with regard to the fields of application of the invention.

The invention claimed is:

1. A container (1) for the storage of products in a modified atmosphere, comprising:

a seal;

a box (2) for storing the products; and a lid (3) for reversibly closing the box (2) in an airtight manner by means of the seal (20), the box (2) having a flat peripheral rim (4) that comprises an internal flat peripheral rim (5) and an external flat peripheral rim (6), the lid (3) comprising a vertical peripheral rim (7) that covers an entirety of the external peripheral rim (6) of the box (2) when the lid (3) is removably fitted atop the box (2) to close the box (2), the lid (3) also comprising an internal face (8) with a peripheral groove (10) disposed directly opposite the internal flat peripheral rim (5) of the box (2) when the lid (3) closes the box (2), the seal (20) comprising i) a foot (21) that is positioned inside said peripheral groove (10) of the lid (3), and ii) a compressible sealing portion attached to the foot (21) that is crushed against the internal peripheral rim (5) of the box (2) when the foot (21) is in said peripheral groove (10) and the lid (3) closes the box (2), wherein the internal (5) and external (6) peripheral rims are in different planes and together constitute a shouldered shape, and wherein the lid (3) further comprises, between the vertical peripheral rim (7) and the internal face (8), a step (9) having a shape complementary to said shouldered shape of the box (2), a distance between the plane of the step (9) and the plane of the internal face (8) of the lid (3) being less than a distance separating the planes of the peripheral rims of the box (2).

2. The container (1) according to claim 1, wherein said foot (21) comprises means (23) of attachment to the lid (3) arranged so that the seal (20) is removable from the lid (3).

3. The container (1) according to claim 2, wherein said attachment means (23) comprise pegs (24) having in cross section the shape of a fir tree.

4. The container (1) according to claim 1, further comprising:

means (11) of clipping the lid (3) onto the box (2).

5. The container (1) according to claim 4, wherein the clipping means (11) are formed by at least one hollowed-out protuberance (12) provided on the vertical peripheral rim (7), said protuberance (12) being arranged to be attached to the external flat peripheral rim (6) of the box (2) when the lid (3) closes the box (2).

6. The container (1) according to claim 1, wherein the lid (3) comprises at least one orifice (13) closed by a semi-permeable membrane (14) arranged so as to allow storage of the products in a modified atmosphere.

7. The container (1) according to claim 2, further comprising:

means (11) of clipping the lid (3) onto the box (2).

8. The container (1) according to claim 3, further comprising:

means (11) of clipping the lid (3) onto the box (2).

9. The container (1) according to claim 2, wherein the lid (3) comprises at least one orifice (13) closed by a semi-permeable membrane (14) arranged so as to allow storage of the products in a modified atmosphere.

10. The container (1) according to claim 3, wherein the lid (3) comprises at least one orifice (13) closed by a semi-permeable membrane (14) arranged so as to allow storage of the products in a modified atmosphere.

11. The container (1) according to claim 4, wherein the lid (3) comprises at least one orifice (13) closed by a semi-permeable membrane (14) arranged so as to allow storage of the products in a modified atmosphere.

12. The container (1) according to claim 5, wherein the lid (3) comprises at least one orifice (13) closed by a semi-permeable membrane (14) arranged so as to allow storage of the products in a modified atmosphere.

13. A container (1) for storing products in a modified atmosphere, comprising:

a box (2) constituted by a wall that encloses an interior space for storing the products, a mouth of the box (2) delimited by a peripheral rim (4) of the wall that extends outward in a direction away from the interior space of the box (2), said peripheral rim (4) comprised of an internal flat peripheral rim (5) surrounding and external to the wall of the box (2) and an external flat peripheral rim (6) surrounding and external to the internal flat peripheral rim (5), the internal (5) and external (6) peripheral rims being in different planes from each other and connected to each other by a connecting rim and together constituting a shouldered shape;

a removable lid (3) for reversibly closing the box (2), comprising a planar portion that covers the mouth of the box (2) when the lid (3) is fitted over the mouth of the box (2) so that an internal face (8) of the portion faces the interior of the box (2) to close the box (2), the lid (3) also comprising a peripheral groove (10) surrounding the planar portion, the peripheral groove (10) disposed directly opposite the internal flat peripheral rim (5) of the box (2) when the lid (3) is fitted over the mouth of the box (2) to close the box (2); and a seal comprising i) a foot (21) that is positioned inside said peripheral groove (10) of the lid (3), and ii) a compressible sealing portion attached to the foot (21), the compressible sealing portion, when the foot (21) is in said peripheral groove (10) and the lid (3) is fitted over the mouth of the box (2) to close the box (2), being brought to bear against the internal peripheral rim (5) so as to be compressed against the internal peripheral rim (5) to form a seal between the box (2) and the lid (3).

14. The container (1) according to claim 13, wherein the lid (3) further comprises a step (9) having a shape complementary to the shouldered shape of the internal (5) and external (6) peripheral rims of the box (2), so as to receive the shouldered shape within an interior of the step (9) when the lid (3) is fitted over the mouth of the box (2) to close the box (2), the step formed by a vertical portion at a periphery of the lid (3) external to the peripheral groove (10), a horizontal portion extending outward from the vertical portion, and a vertical peripheral rim (7) at an outermost periphery of the lid (3), a vertical distance between the plane of horizontal portion of the step (9) and the plane of the internal face (8) of the lid (3) being less than a vertical distance separating the planes of the internal (5) and external (6) peripheral rims of the box (2).

15. The container (1) according to claim 14, wherein the vertical peripheral rim (7) extends over an outermost periphery of the external peripheral rim (6) of the box (2) when the lid (3) is fitted over the mouth of the box (2) to close the box (2).

16. The container (1) according to claim 15, wherein the vertical peripheral rim (7) comprises at least one hollowed-out protuberance (12) that attaches to the external flat peripheral rim (6) of the box (2) when the lid (3) is fitted over the mouth of the box (2) to close the box (2).

17. The container (1) according to claim 13, wherein the foot (21) is removable from the peripheral groove (10).

18. The container (1) according to claim 13, wherein the sealing portion is hollow and consists of a flexible material.

19. The container (1) according to claim 13, wherein the lid (3) further comprises at least one orifice (13) closed by a semi-permeable membrane (14).

* * * * *

UNITED STATES PATENT AND TRADEMARK OFFICE

CERTIFICATE OF CORRECTION

PATENT NO. : 8,579,150 B2
APPLICATION NO. : 12/306985
DATED : November 12, 2013
INVENTOR(S) : Pierre Janny It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 562 days.

Signed and Sealed this
Twenty-second Day of September, 2015

Michelle K. Lee

Michelle K. Lee
*Director of the United States Patent and Trademark Office*